US009620063B2

(12) United States Patent
Kim

(10) Patent No.: US 9,620,063 B2
(45) Date of Patent: Apr. 11, 2017

(54) GATE DRIVING CIRCUIT AND ORGANIC LIGHT EMITTING DISPLAY DEVICE HAVING THE SAME

(71) Applicant: Samsung Display Co., Ltd., Yongin, Gyeonggi-Do (KR)

(72) Inventor: Hyun-Joon Kim, Yongin-si (KR)

(73) Assignee: SAMSUNG DISPLAY CO., LTD., Yongin (KR)

( * ) Notice: Subject to any disclaimer, the term of this patent is extended or adjusted under 35 U.S.C. 154(b) by 79 days.

(21) Appl. No.: 14/588,866

(22) Filed: Jan. 2, 2015

(65) Prior Publication Data

US 2015/0356913 A1 Dec. 10, 2015

(30) Foreign Application Priority Data

Jun. 9, 2014 (KR) ..... 10-2014-0069667

(51) Int. Cl.
*G09G 3/30* (2006.01)
*G09G 3/3266* (2016.01)

(52) U.S. Cl.
CPC ..... *G09G 3/3266* (2013.01)

(58) Field of Classification Search
CPC ..... G09G 3/3266; G09G 2310/0256; G09G 3/30; G09G 3/3674; G09G 3/3208; G09G 2310/0251
See application file for complete search history.

(56) References Cited

U.S. PATENT DOCUMENTS 8,299,982 B2 * 10/2012 Chung ..... G09G 3/3266 345/76
2006/0125737 A1 * 6/2006 Kwak ..... G09G 3/3233 345/76
2006/0158394 A1 7/2006 Choi
2007/0045620 A1 * 3/2007 Park ..... G09G 3/3233 257/40
2009/0109150 A1 * 4/2009 Han ..... G09G 3/3233 345/82
2010/0013824 A1 1/2010 Kim et al.
2012/0038609 A1 * 2/2012 Chung ..... G09G 3/003 345/211
2012/0062525 A1 3/2012 Kim
2013/0342584 A1 * 12/2013 Song ..... G09G 3/3266 345/690
2014/0064436 A1 3/2014 Ma

FOREIGN PATENT DOCUMENTS

KR 10-2006-0073680 A 6/2006
KR 10-2010-0008502 A 1/2010
KR 10-2012-0028006 A 3/2012
KR 10-2013-0130721 A 12/2013

* cited by examiner

*Primary Examiner* — Andrew Sasinowski
*Assistant Examiner* — Gerald Oliver
(74) *Attorney, Agent, or Firm* — Ladas & Parry LLP

(57) ABSTRACT

A gate driver includes a plurality of stages. Each stage includes a first input circuit, a first gate signal circuit, a second gate signal circuit, an inverting circuit, a first emission signal circuit, and a second emission signal circuit. The first gate signal circuit and second gate signal circuit are configured to generate a first logic level or a second logic level. The first emission signal circuit and the second emission signal circuit are configured to generate a first voltage or a second voltage in response to a voltage of a first node or a second node.

20 Claims, 7 Drawing Sheets

GATE DRIVING CIRCUIT AND ORGANIC LIGHT EMITTING DISPLAY DEVICE HAVING THE SAME

CROSS-REFERENCE TO RELATED APPLICATION(S)

This application claims priority under 35 U.S.C. §119 to Korean Patent Applications No. 10-2014-0069667, filed on Jun. 9, 2014 in the Korean Intellectual Property Office (KIPO), the contents of which are incorporated herein in its entirety by reference.

BACKGROUND

Technical Field

The present disclosure generally relates to a display device. More specifically, the present disclosure relates to a gate driving circuit and an organic light emitting display device having the gate driving circuit.

Description of the Related Art

Generally, an organic light emitting display device includes a display panel and a panel driving unit. The display panel includes a plurality of gate lines, a plurality of data lines, a plurality of emission lines, and a plurality of pixels. The panel driving unit includes a gate driving circuit for providing gate signals to the gate lines, a data driving circuit for providing data signals to the data lines, and a emission driving circuit for providing emission signals to the emission lines.

The gate driving circuit includes a plurality of stages, each stage outputting its own gate signal. The emission driving circuit includes a plurality of stages, each state outputting its own emission signal. The emission signals control switching elements included in a pixel circuit to adjust the duty ratio of the organic light emitting diode included in each pixel and to initialize a capacitor of the pixel circuit.

SUMMARY

Some example aspects provide a gate driving circuit capable of outputting gate signals and emission signals.

Some example aspects provide an organic light emitting display device having the gate driving circuit.

According to some example aspects, a gate driving circuit may include a plurality of stages outputting a plurality of gate signals and a plurality of emission signals, respectively. Each stage may include a first input part configured to apply a first input signal to a first node in response to the first input signal, a first gate signal output part configured to control a corresponding one of the gate signals to a first logic level in response to a voltage of the first node, a second gate signal output part configured to control the corresponding one of the gate signals to a second logic level in response to a second input signal, an inverting part configured to invert the voltage of the first node in response to a clock signal and the voltage of the first node, and to apply the inverted voltage to a second node, a first emission signal output part configured to output a first voltage as a corresponding one of the emission signals in response to a voltage of the second node, and a second emission signal output part configured to output a second voltage as the corresponding one of the emission signals in response to the voltage of the first node.

In example aspects, each stage may further include a charging part including a first capacitor, the first capacitor having a first electrode connected to the second node and a second electrode connected to a second voltage terminal providing the second voltage.

In example aspects, the inverting part may include a first inverting transistor including a control electrode to which the clock signal is applied, an input electrode to which the clock signal is applied, and an output electrode connected to the second node, and a second inverting transistor including a control electrode connected to the first node, an input electrode to which the second voltage is applied, and an output electrode connected to the second node.

In example aspects, each stage may further include a second input part configured to apply the second voltage to the first node in response to the second input signal.

In example aspects, the second input part may include a second input transistor including a control electrode to which the second input signal is applied, an input electrode to which the second voltage is applied, and an output electrode connected to the first node.

In example aspects, each stage may further include a first holding part configured to apply the second voltage to the first node in response to the voltage of the second node.

In example aspects, the first holding part may include a first holding transistor including a control electrode connected to the second node, an input electrode to which the second voltage is applied, and an output electrode connected to the first node.

In example aspects, each stage may further include a second holding part configured to output the second voltage as the corresponding one of the gate signals in response to the voltage of the second node.

In example aspects, the second holding part may include a second holding transistor including a control electrode connected to the second node, an input electrode to which the second voltage is applied, and an output electrode connected to a gate output terminal outputting the corresponding one of the gate signals.

In example aspects, the first input part may include a first input transistor including a control electrode to which the first input signal is applied, an input electrode to which the first input signal is applied, and an output electrode connected to the first node.

In example aspects, the first gate signal output part may include a first output transistor including a control electrode connected to the first node, an input electrode to which the clock signal is applied, and an output electrode connected to a gate output terminal outputting the corresponding one of the gate signals and a second capacitor including a first electrode connected to the first node and a second electrode connected to the gate output terminal.

In example aspects, the second gate signal output part may include a second output transistor including a control electrode to which the second input signal is applied, an input electrode to which the second voltage is applied, and an output electrode connected to a gate output terminal outputting the corresponding one of the gate signals.

In example aspects, the first emission signal output part may include a third output transistor including a control electrode connected to the second node, an input electrode to which the first voltage is applied, and an output electrode connected to an emission output terminal outputting the corresponding one of the emission signals.

In example aspects, the second emission signal output part may include a fourth output transistor including a control electrode connected to the first node, an input electrode to which the second voltage is applied, and an output electrode connected to an emission output terminal outputting the corresponding one of the emission signals.

According to some example aspects, a gate driving circuit may include a plurality of stages outputting a plurality of gate signals and a plurality of emission signals, respectively. Each stage may include a first input part configured to apply a first input signal to a first node in response to the first input signal, a first gate signal output part configured to control a corresponding one of the gate signals to a first logic level in response to a voltage of the first node, a second gate signal output part configured to control the corresponding one of the gate signals to a second logic level in response to a second input signal, and an inverting part configured to invert the voltage of the first node in response to a clock signal and the voltage of the first node, and to apply the inverted voltage to a second node, a voltage of the second node being output as a corresponding one of the emission signals.

In example aspects, the inverting part may include a first inverting transistor including a control electrode to which the clock signal is applied, an input electrode to which the clock signal is applied, and an output electrode connected to the second node, and a second inverting transistor including a control electrode connected to the first node, an input electrode to which a second voltage is applied, and an output electrode connected to the second node.

In example aspects, each stage may further include a second input part configured to apply a second voltage to the first node in response to the second input signal.

In example aspects, each stage may further include a first holding part configured to apply a second voltage to the first node in response to the voltage of the second node.

In example aspects, each stage may further include a second holding part configured to output a second voltage as the corresponding one of the gate signals in response to the voltage of the second node.

According to some example aspects, a display device may include a display panel including a plurality of gate lines, a plurality of emission lines, a plurality of data lines crossing the gate lines and the emission lines, and a plurality of pixels, a data driving circuit configured to output a plurality of data signals to the data lines, respectively, and a gate driving circuit including a plurality of stages outputting a plurality of gate signals to the gate lines and outputting a plurality of emission signals to the emission lines, respectively. Each stage may include a first input part configured to apply a first input signal to a first node in response to the first input signal, a second input part configured to apply a second voltage to the first node in response to a second input signal, a first gate signal output part configured to control a corresponding one of the gate signals to a first logic level in response to a voltage of the first node, a second gate signal output part configured to control the corresponding one of the gate signals to a second logic level in response to the second input signal, an inverting part configured to invert the voltage of the first node in response to a clock signal and the voltage of the first node, and to apply the inverted voltage to a second node, a first holding part configured to apply the second voltage to the first node in response to a voltage of the second node, a second holding part configured to output the second voltage as the corresponding one of the gate signals in response to the voltage of the second node, a first emission signal output part configured to output a first voltage as a corresponding one of the emission signals in response to the voltage of the second node, and a second emission signal output part configured to output the second voltage as the corresponding one of the emission signals in response to the voltage of the first node.

According to some example aspects, a gate driver including a plurality of stages. One of those stages may include: a first input circuit configured to apply a first input signal to a first node; a first gate signal circuit configured to generate a first logic level in response to a voltage of the first node; a second gate signal circuit configured to generate a second logic level in response to a second input signal; an inverting circuit configured to invert the voltage of the first node in response to a clock signal and the voltage of the first node, the inverting circuit further configured to apply the inverted voltage to a second node; a first emission signal circuit configured to generate a first voltage in response to a voltage of the second node; and a second emission signal circuit configured to generate a second voltage in response to the voltage of the first node.

In example aspects, the stage may further include a charging circuit including a first capacitor, the first capacitor having a first electrode connected to the second node and a second electrode connected to a second voltage terminal providing the second voltage.

In example aspects, the inverting circuit may include a first inverting transistor including a control electrode to which the clock signal is applied, an input electrode to which the clock signal is applied, and an output electrode connected to the second node, and a second inverting transistor including a control electrode connected to the first node, an input electrode to which the second voltage is applied, and an output electrode connected to the second node.

In example aspects, the stage may further include a second input circuit configured to apply the second voltage to the first node in response to the second input signal.

In example aspects, the second input circuit may include a second input transistor including a control electrode to which the second input signal is applied, an input electrode to which the second voltage is applied, and an output electrode connected to the first node.

In example aspects, the stage may further include a first holding circuit configured to apply the second voltage to the first node in response to the voltage of the second node.

In example aspects, the first holding circuit may include a first holding transistor including a control electrode connected to the second node, an input electrode to which the second voltage is applied, and an output electrode connected to the first node.

In example aspects, the stage may further include a second holding circuit configured to generate the second voltage in response to the voltage of the second node.

In example aspects, the second holding circuit may include a second holding transistor including a control electrode connected to the second node, an input electrode to which the second voltage is applied, and an output electrode connected to a gate output terminal outputting a gate signal of said one stage.

In example aspects, the first input circuit may include a first input transistor including a control electrode to which the first input signal is applied, an input electrode to which the first input signal is applied, and an output electrode connected to the first node.

In example aspects, the first gate signal circuit may include a first output transistor including a control electrode connected to the first node, an input electrode to which the clock signal is applied, and an output electrode connected to a gate output terminal outputting a gate signal of said one stage, and a second capacitor including a first electrode connected to the first node and a second electrode connected to the gate output terminal.

In example aspects, the second gate signal circuit may include a second output transistor including a control electrode to which the second input signal is applied, an input electrode to which the second voltage is applied, and an output electrode connected to a gate output terminal outputting a gate signal of said one stage.

In example aspects, the first emission signal circuit may include a third output transistor including a control electrode connected to the second node, an input electrode to which the first voltage is applied, and an output electrode connected to an emission output terminal outputting an emission signal of said one stage.

In example aspects, the second emission signal circuit may include a fourth output transistor including a control electrode connected to the first node, an input electrode to which the second voltage is applied, and an output electrode connected to an emission output terminal outputting an emission signal of said one stage.

According to some example aspects, a gate driver may include a plurality of stages. One of the plurality of stages may include: a first input circuit configured to apply a first input signal to a first node; a first gate signal circuit configured to generate a first logic level in response to a voltage of the first node; a second gate signal circuit configured to generate a second logic level in response to a second input signal; and an inverting circuit configured to invert the voltage of the first node in response to a clock signal and the voltage of the first node, the inverting circuit further configured to apply the inverted voltage to a second node and cause a voltage of the second node to be output as an emission signal.

In example aspects, the inverting circuit may include a first inverting transistor including a control electrode to which the clock signal is applied, an input electrode to which the clock signal is applied, and an output electrode connected to the second node, and a second inverting transistor including a control electrode connected to the first node, an input electrode to which a second voltage is applied, and an output electrode connected to the second node.

In example aspects, the stage may further include a second input circuit configured to apply a second voltage to the first node in response to the second input signal.

In example aspects, the stage may further include a first holding circuit configured to apply a second voltage to the first node in response to the voltage of the second node.

In example aspects, the stage may further include a second holding circuit configured to generate a second voltage in response to the voltage of the second node.

According to some example aspects, a display device may include: a display panel including a plurality of gate lines, a plurality of emission lines, a plurality of data lines crossing the gate lines and the emission lines, and a plurality of pixels; a data driver configured to output a plurality of data signals to the data lines, respectively; and a gate driver including a plurality of stages. One of the plurality of stages may include: a first input circuit configured to apply a first input signal to a first node; a second input circuit configured to apply a second voltage to the first node in response to a second input signal; a first gate signal circuit configured to generate a first logic level in response to a voltage of the first node; a second gate signal circuit configured to generate a second logic level in response to the second input signal; an inverting circuit configured to invert the voltage of the first node in response to a clock signal and the voltage of the first node, the inverting circuit further configured to apply the inverted voltage to a second node; a first holding circuit configured to apply the second voltage to the first node in response to a voltage of the second node; a second holding circuit configured to generate the second voltage in response to the voltage of the second node; a first emission signal circuit configured to generate a first voltage in response to the voltage of the second node; and a second emission signal circuit configured to generate the second voltage in response to the voltage of the first node.

Therefore, according to example embodiments of the present disclosure, a gate driving circuit may output both gate signals and emission signals, thereby reducing the number of transistors included in a panel driving unit.

In addition, according to example embodiments of the present disclosure, an organic light emitting display device outputs gate signals and emission signals using a gate driving circuit without an emission driving circuit. Therefore, the organic light emitting display device can have a narrow bezel, thereby reducing size of the organic light emitting display device.

BRIEF DESCRIPTION OF THE DRAWINGS

Illustrative, non-limiting example embodiments of the present disclosure will be more clearly understood from the detailed description provided below, when taken in conjunction with the following accompanying drawings.

DETAILED DESCRIPTION OF THE EMBODIMENTS

Example embodiments will be described more fully hereinafter with reference to the accompanying drawings, in which various embodiments are shown.

Figure 1:
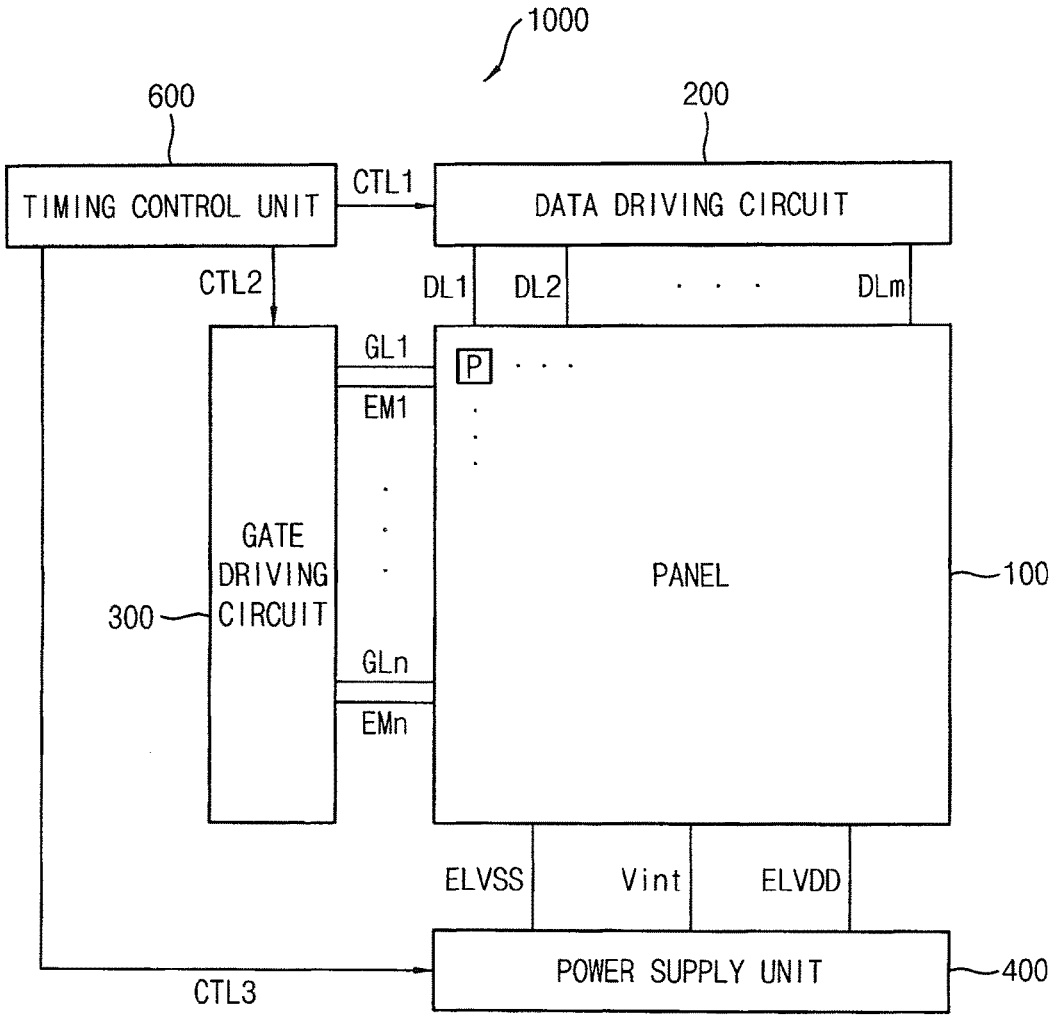
FIG. 1 is a block diagram illustrating an organic light emitting display device according to example embodiments.

FIG. 1 is a block diagram illustrating an example of an organic light emitting display device according to example embodiments.

Referring to FIG. 1, an organic light emitting display device 1000 may include a display panel 100, a data driving circuit 200, a gate driving circuit 300, a power supply unit 400, and a timing control unit 600.

The display panel 100 may include a plurality of gate lines GL1 through GLn, a plurality of emission lines EM1 through EMn, a plurality of data lines DL1 through DLm, and a plurality of pixels P. The gate lines GL1 through GLn and the emission lines EM1 through EMn may be coupled to the gate driving circuit 300. The data lines DL1 through DLm may be coupled to the data driving circuit 200. The display device 100 may include n*m pixels P because the display device 100 may have one pixel P at every location where the gate lines GL1 through GLn generally cross the data lines DL1 through DLm. For example, the display device 100 may be n pixels P for each one of the m date lines DL1 through DLm, resulting in n*m pixels P in total.

The data driving circuit 200 may provide data signals to the pixels P via the data lines DL1 through DLm.

The gate driving circuit 300 may provide gate signals to the pixels P via the gate lines GL1 through GLn. In addition to providing the gate signals, the gate driving circuit 300 may provide emission signals to the pixels P via the emission lines EM1 through EMn. In some embodiments, the gate driving circuit 300 controls the driving current flowing through the organic light emitting diode included in each pixel P using the gate signal and the emission signal provided by the gate driving circuit 300. For example, the gate driving circuit 300 may provide a gate signal to a pixel P such that the pixel circuit included in the pixel P receives a data signal provided by the data driving circuit 200. The gate driving circuit 300 may provide an emission signal to the pixel P to cause the organic light emitting diode of the pixel P to emit light. In one example embodiment, the organic light emitting display device 1000 may include a plurality of the gate driving circuits 300. In one example, the organic light emitting display device 1000 may include two gate driving circuits 300 located both sides of the display panel 100. In this example, the display panel 100 may be divided into two regions, and each of the two gate driving circuits 300 may provide gate signals and emission signals to the corresponding regions of the display panel 100. The organic light emitting display device 1000 may include non-display regions that have substantially equal sizes.

The power supply unit 400 may provide a high power voltage ELVDD, a low power voltage ELVSS, and an initial voltage Vint to each of the pixels P via power lines.

The timing control unit 600 may generate control signals CTL1, CTL2, and CTL3. The timing control unit 600 may provide the control signals CTL1, CTL2, or CTL3 to the data driving circuit 200, the gate driving circuit 300, or the power supply unit 400 to control the data driving circuit 200, the gate driving circuit 300, or the power supply unit 400.

Therefore, according to the example configuration illustrated in FIG. 1, the organic light emitting display device 1000 may output the gate signals and the emission signals using the gate driving circuit 300 and without using a separate emission driving circuit. Thus, by not having a separate emission driving circuit, the organic light emitting display device 1000 may have a narrower bezel compared to a configuration having an emission driving circuit in addition to the gate driving circuit, and the size of the organic light emitting display device 1000 may be reduced.

Figure 2:
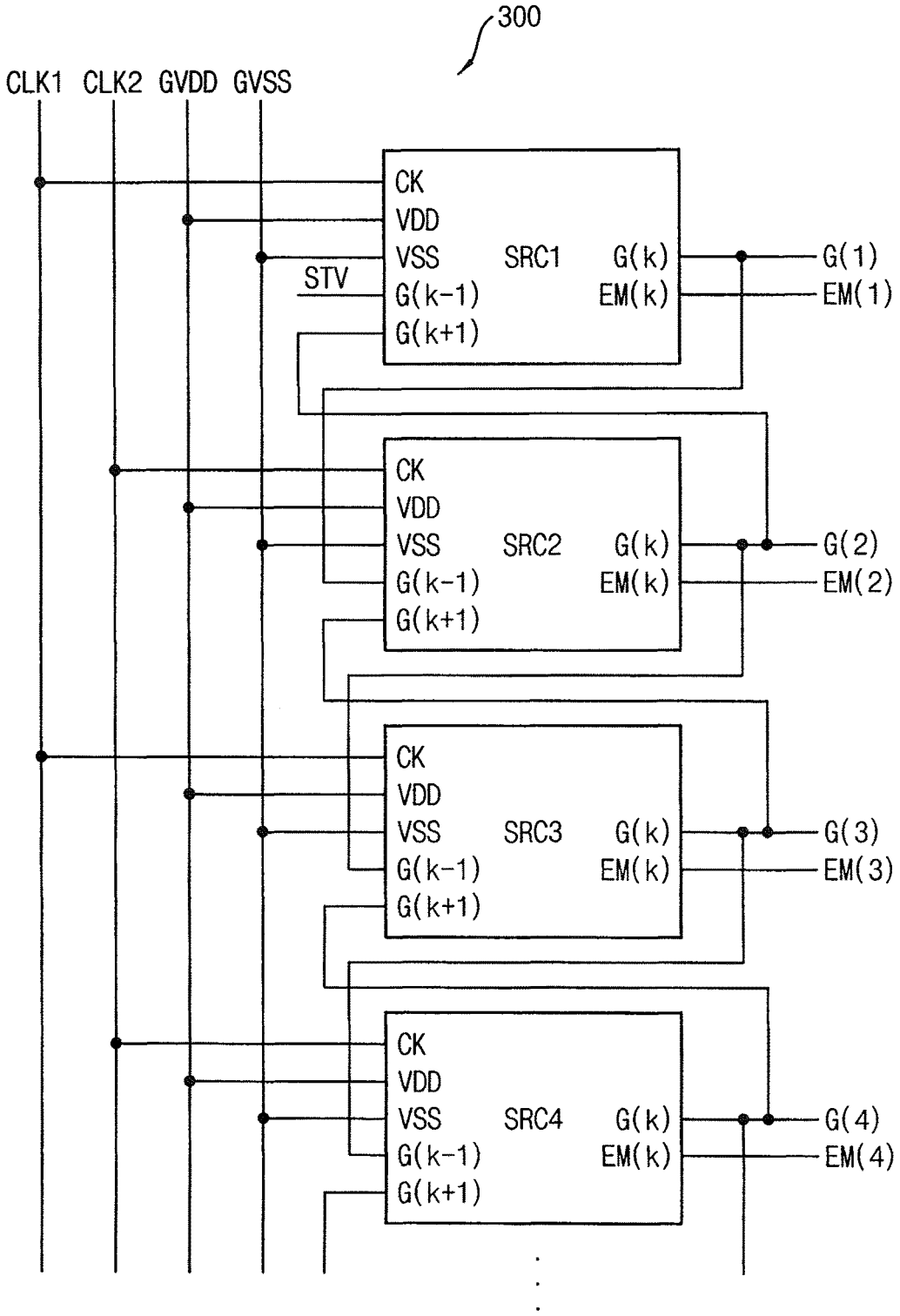
FIG. 2 is a block diagram illustrating an example of a gate driving circuit included in an organic light emitting display device of FIG. 1.

FIG. 2 is a block diagram illustrating an example of a gate driving circuit included in an organic light emitting display device of FIG. 1.

Referring to FIG. 2, a gate driving circuit 300 may include a plurality of stages SRC1, SRC2, SRC3, SRC4, etc. that are dependently connected to each other. Each of the stages SRC1, SRC2, SRC3, SRC4, etc. may include a clock terminal CK, a first voltage terminal VDD, a second voltage terminal VSS, a first input terminal G(k−1), a second input terminal G(k+1), a gate output terminal G(k), and an emission output terminal EM(k).

A first gate clock signal CLK1 and a second gate clock signal CLK2 having different timings may be applied to the clock terminal CK of the stages SRC1, SRC2, SRC3, SRC4, etc. For example, the second gate clock signal CLK2 may be a signal inverted from the first gate clock signal CLK1. In another example, the second clock signal CLK2 may be the first gate clock signal CLK1 delayed by a specific time period. In adjacent stages, the first gate clock signal CLK1 and the second gate clock signal CLK2 may be applied to the clock terminal CK of the stages SRC1, SRC2, SRC3, SRC4, etc. in an alternating manner. For example, the first gate clock signal CLK1 may be applied to the clock terminal CK of the odd-numbered stages SRC1, SRC3, etc. On the other hand, the second gate clock signal CLK2 may be applied to the clock terminal CK of the even-numbered stages SRC2, SRC4, etc.

A first voltage GVDD may be provided to the first voltage terminal VDD of the stages SRC1, SRC2, SRC3, SRC4, etc. For example, the first voltage GVDD may be a high level voltage.

A second voltage GVSS may be provided to the second voltage terminal VSS of the stages SRC1, SRC2, SRC3, SRC4, etc. For example, the second voltage GVSS may be a low level voltage.

A first input signal may be applied to the first input terminal G(k−1) of the stages SRC1, SRC2, SRC3, SRC4, etc. The first input signal may be a vertical start signal STV or a gate signal of the previous stage. For example, the vertical start signal STV is applied to the first input terminal G(k−1) of the first stage SRC1. The gate signals of the previous stages are respectively applied to the first input terminal G(k−1) of the second through (n)th stages SRC2 through SRCn.

A second input signal may be applied to the second input terminal G(k+1) of the stages SRC1, SRC2, SRC3, SRC4, etc. The second input signal may be a gate signal of the next stage or the vertical start signal STY. For example, the gate signals of the next stages may be respectively applied to each second input terminal G(k+1) of the first through (n−1)th stages SRC1 through SRCn−1. The vertical start signal STV may be applied to the second input terminal G(k+1) of the (n)th stage SRCn.

The gate output terminal G(k) may output the gate signal to the gate line electrically connected to the gate output terminal G(k). In one example, the gate signals G(1), G(3), etc. from the gate output terminal G(k) of the odd-numbered stages SRC1, SRC3, etc. may be outputted in sync with a high signal of the first gate clock signal CLK1. Also, the gate signals G(2), G(4), etc. from the gate output terminal G(k) of the even-numbered stages SRC2, SRC4, etc. may be outputted in sync with a high signal of the second gate clock signal CLK2.

The emission output terminal EM(k) may output an emission signal to the emission line electrically connected to the emission output terminal EM(k). The emission signal may have a second logic level (e.g., low level) while the gate signal has a first logic level (e.g., high level).

Figure 3:
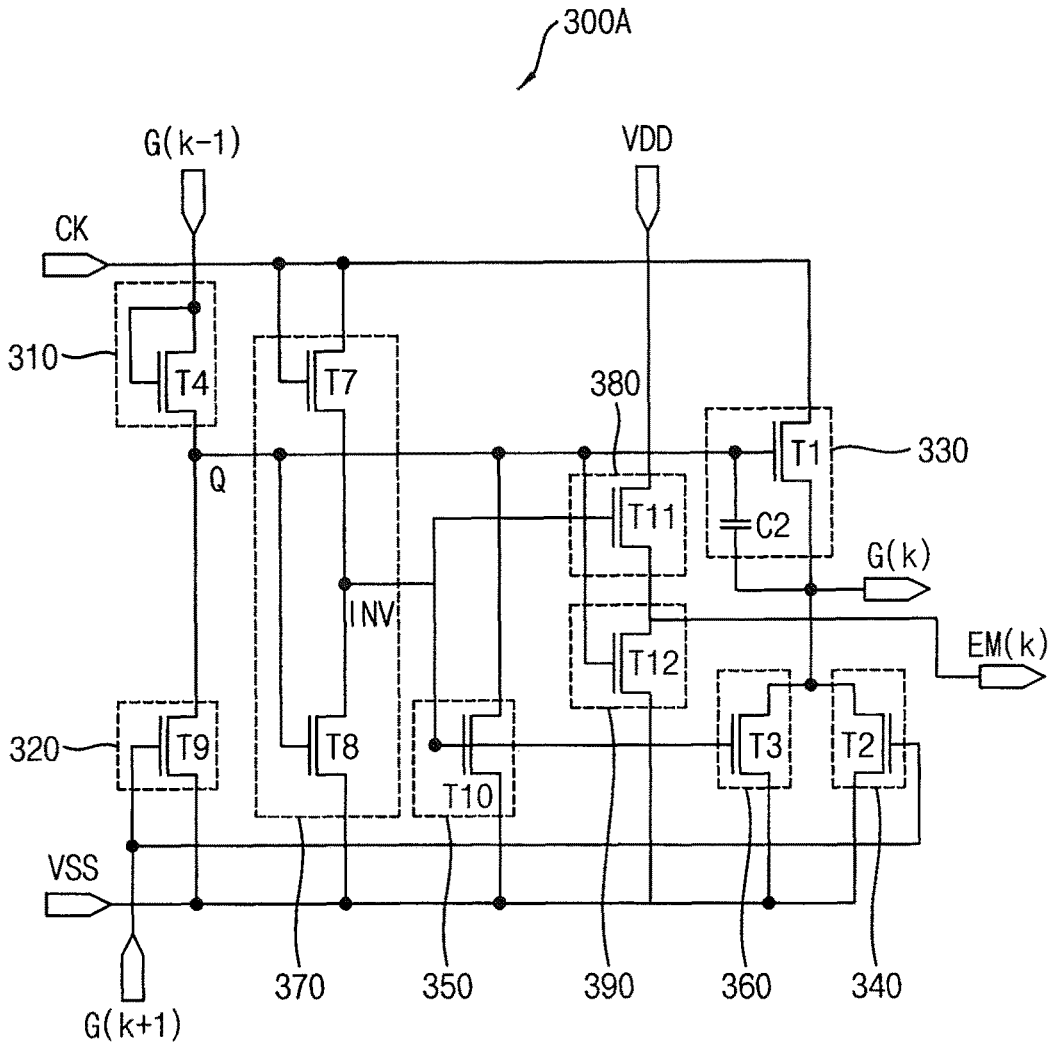
FIG. 3 is a circuit diagram illustrating an example of an (k)th stage included in a gate driving circuit of FIG. 2.

FIG. 3 is a circuit diagram illustrating an example of a (k)th stage of a gate driving circuit (e.g., the gate driving circuit 300 of FIG. 2).

Referring to FIG. 3, the (k)th stage 300A of a gate driving circuit may include a first input part 310, a second input part 320, a first gate signal output part 330, a second gate signal output part 340, a first holding part 350, a second holding part 360, an inverting part 370, a first emission signal output part 380, and a second emission signal output part 390. A first input signal may be applied to the first input terminal G(k−1) of the (k)th stage 300A. A second input signal may be applied to the second input terminal G(k+1) of the (k)th stage 300A. A clock signal may be applied to a clock terminal CK of the (k)th stage 300A. A first voltage (e.g., high level voltage) may be applied to a first voltage terminal VDD of the (k)th stage 300A. A second voltage (e.g., low level voltage) may be applied to a second voltage terminal VSS of the (k)th stage 300A. In one example, the clock signal is a first gate clock signal when k is an odd number and a second gate clock signal when k is an even number. The (k)th stage 300A may output a (k)th gate signal to a gate output terminal G(k) of the gate driving circuit 300. The (k)th stage 300A may output a (k)th emission signal to a emission output terminal EM(k) of the gate driving circuit 300.

The first input part 310 may apply the first input signal to a first node Q in response to the first input signal. For example, the first input part 310 may apply the gate signal of the previous stage to the first node Q in response to the gate signal of the previous stage. In one example, the first input part 310 may apply the gate signal to the first node Q if the gate signal is high. Alternatively, in another example, the first input part 310 may apply the gate signal to the first node Q if the gate signal is low. The first input part 310 may include a first input transistor T4. The first input transistor T4 may include a control electrode to which the first input signal is applied, an input electrode to which the first input signal is applied, and an output electrode connected to the first node Q. As shown in FIG. 3, the control electrode and the input electrode may be connected to each other.

The second input part 320 may apply the second voltage to the first node Q in response to the second input signal. For example, the second input part 320 may apply the second voltage to the first node Q in response to the gate signal of the next stage. In one example, the second input part 320 may apply the second voltage to the first node Q if the gate signal is high. Alternatively, in another example, the second input part 320 may apply the second voltage to the first node Q if the gate signal is low. The second input part 320 may include a second input transistor T9. The second input transistor T9 may include a control electrode to which the second input signal is applied, an input electrode to which the second voltage is applied, and an output electrode connected to the first node Q.

The first gate signal output part 330 may control the (k)th gate signal to be output to the gate output terminal G(k) to be at a first logic level (e.g., high level) in response to a voltage of the first node Q. For example, the first gate signal output part 330 may set the (k)th gate signal to a high level when the voltage of the first node Q is high. The first gate signal output part 330 may include a first output transistor T1 and a second capacitor C2. The first output transistor T1 may include a control electrode connected to the first node Q, an input electrode to which the clock signal is applied, and an output electrode connected to the gate output terminal G(k) of the gate driving circuit 300. The second capacitor C2 may include a first electrode connected to the first node Q and a second electrode connected to the gate output terminal G(k) of the gate driving circuit 300.

The second gate signal output part 340 may control the (k)th gate signal to be output to the gate output terminal G(k) to a second logic level (e.g., low level) in response to the second input signal. For example, the second gate signal output part 340 may set the (k)th gate signal to a low level when the second input signal is at a high level. The second gate signal output part 340 may include a second output transistor T2. The second output transistor T2 may include a control electrode to which the second input signal is applied, an input electrode to which the second voltage is applied, and an output electrode connected to the gate output terminal G(k) of the gate driving circuit 300.

The first holding part 350 may apply the second voltage to the first node Q in response to the voltage of a second node INV. The first holding part 350 may include a first holding transistor T10. The first holding transistor T10 may include a control electrode connected to the second node INV, an input electrode to which the second voltage is applied, and an output electrode connected to the first node Q.

The second holding part 360 may output the second voltage as the (k)th gate signal of the stage 300A in response to the voltage of the second node INV. For example, the second holding part 360 may output the second voltage as the (k)th gate signal when the voltage of the second node INV is high. The second holding part 360 may include a second holding transistor T3. The second holding transistor T3 may include a control electrode connected to the second node INV, an input electrode to which the second voltage is applied, and an output electrode connected to the gate output terminal G(k).

The inverting part 370 may invert the voltage of the first node Q in response to the clock signal and the voltage of the first node Q. The inverting part 370 may apply the inverted voltage to the second node INV For example, the inverting part 370 may invert the voltage of the first node Q and apply the inverted voltage to the second node INV when at least one of the voltage of the first node Q and the clock signal is high. The inverting part 370 may include a first inverting transistor T7 and a second inverting transistor T8. The first inverting transistor T7 may include a control electrode to which the clock signal is applied, an input electrode to which the clock signal is applied, and an output electrode connected to the second node INV. The second inverting transistor T8 may include a control electrode connected to the first node Q, an input electrode to which the second voltage is applied, and an output electrode connected to the second node INV.

The first emission signal output part 380 may output the first voltage as the (k)th emission signal of the stage 300A in response to the voltage of the second node INV The first emission signal output part 380 may include a third output transistor T11. The third output transistor T11 may include a control electrode connected to the second node INV, an input electrode to which the first voltage is applied, and an output electrode connected to the emission output terminal EM(k). The first emission signal output part 380 may apply the first voltage (e.g., high level voltage) to the emission output terminal EM(k) in response to the voltage of the second node INV, which may be the inverted voltage of the first node Q. For example, the first emission signal output part 380 may apply the first voltage to the emission output terminal EM(k) when the voltage of the second node INV is high. Therefore, the first emission signal output part 380 may maintain the (k)th emission signal to the first logic level (e.g., high level), thereby preventing the ripple of the (k)th emission signal.

The second emission signal output part 390 may output the second voltage as the (k)th emission signal of the stage 300A in response to the voltage of the first node Q. The second emission signal output part 390 may include a fourth output transistor T12. The fourth output transistor T12 may include a control electrode connected to the first node Q, an input electrode to which the second voltage is applied, and an output electrode connected to the emission output terminal EM(k). The second emission signal output part 390 may apply the second voltage (e.g., low level voltage) to the emission output terminal EM(k) in response to the voltage of the first node Q. For example, the second emission signal output part 390 may apply the second voltage to the emission output terminal EM(k) when the voltage of the first node Q is high. Therefore, the second emission signal output part 390 may maintain the (k)th emission signal to the second logic level (e.g., low level), thereby controlling the (k)th emission signal to the inverted level of the (k)th gate signal.

Figure 4:
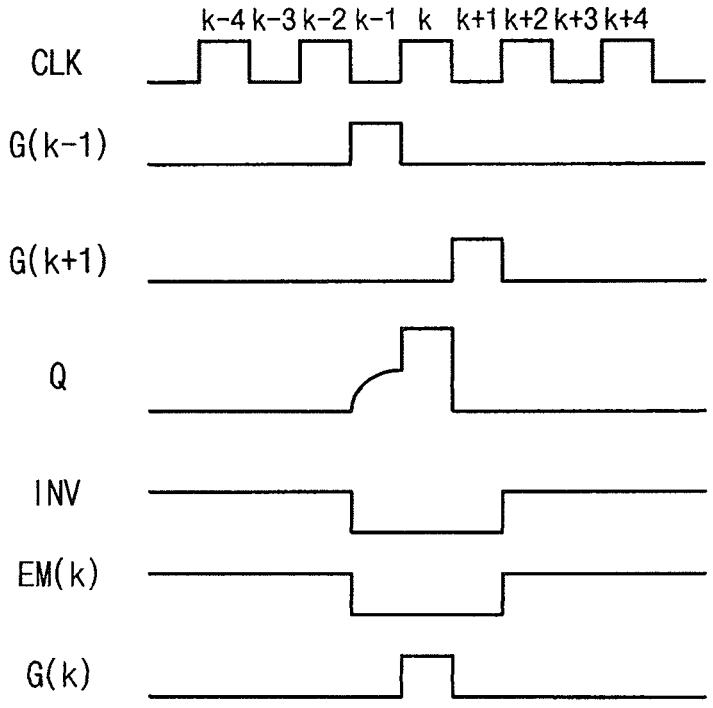
FIG. 4 is a waveform diagram illustrating an example of input signals, node signals, and output signals in a gate driving circuit of FIG. 2.

FIG. 4 is a waveform diagram illustrating an example of input signals, node signals, and output signals in a gate driving circuit (e.g., the gate driving circuit 300 of FIG. 2).

Referring to FIG. 4, a clock signal CLK may have a high level corresponding to the (k−4)th stage, (k−2)th stage, the (k)th stage, the (k+2)th stage, and the (k+4)th stage.

The first input signal G(k−1) of the (k)th stage may have a high level corresponding to the (k−1)th stage. The second input signal G(k+1) of the (k)th stage may have a high level corresponding to th (k+1)th stage.

The voltage of the first node Q of the (k)th stage may be increased to a first level corresponding to the (k−1)th stage by the first input part. The voltage of the first node Q of the (k)th stage may be increased to a second level, which is higher than the first level, corresponding to the (k)th stage by the first output transistor T1 and the second capacitor C2 included in the first gate signal output part. The voltage of the first node Q of the (k)th stage may be decreased corresponding to the (k+1)th stage by the second gate signal output part.

The voltage of the second node INV of the (k)th stage may have a low level while the voltage of the first node Q has a high level. For example, the voltage of the second node INV may be controlled to the low level corresponding to the (k−1)th stage by the second inverting transistor T8 of the inverting part. The voltage of the second node INV may be controlled to the high level corresponding to the (k+1)th stage by the first inverting transistor T7 of an inverting part.

The emission signal EM(k) of the (k)th stage may have a waveform that is substantially equal to the waveform of voltage of the second node INV. Thus, the emission signal EM(k) may be controlled to the low level corresponding to the (k−1)th stage by the second emission signal output part. The emission signal EM(k) may be controlled to the high level corresponding to the (k+1)th stage by the first emission signal output part.

The gate signal G(k) of the (k)th stage may have the high level corresponding to the (k)th stage in sync with the clock signal CLK.

Figure 5:
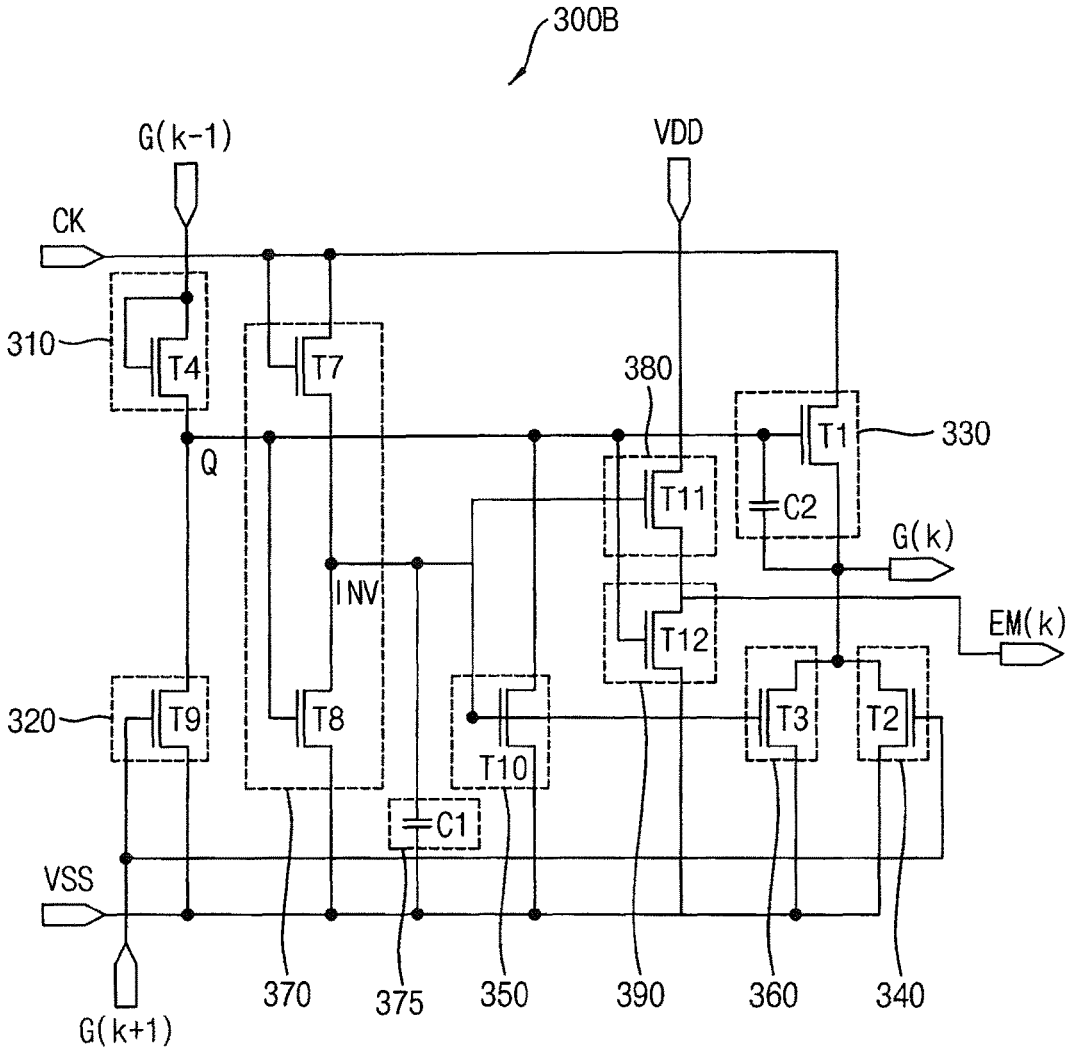
FIG. 5 is a circuit diagram illustrating another example of an (k)th stage included in a gate driving circuit of FIG. 2.

FIG. 5 is a circuit diagram illustrating another example of an (k)th stage included in a gate driving circuit (e.g., the gate driving circuit 300 of FIG. 2).

Referring to FIG. 5, a (k)th stage 300B of a gate driving circuit may include a first input part 310, a second input part 320, a first gate signal output part 330, a second gate signal output part 340, a first holding part 350, a second holding part 360, an inverting part 370, a charging part 375, a first emission signal output part 380, and a second emission signal output part 390. The (k)th stage 300B according to the example embodiment illustrated in FIG. 4 is substantially the same as the (k)th stage of the example embodiment illustrated in FIG. 3, except that the charging part 375 is added. Therefore, the same reference numerals will be used to refer to the same or like parts as those described with reference to the example embodiment illustrated in FIG. 3, and any repetitive explanation concerning the above elements will be omitted.

The first input part 310 may apply a first input signal to a first node Q in response to the first input signal. The second input part 320 may apply a second voltage to the first node Q in response to a second input signal. The first gate signal output part 330 may control the (k)th gate signal to be at a first logic level (e.g., high level) in response to the voltage of the first node Q. The second gate signal output part 340 may control the (k)th gate signal to be at a second logic level (e.g., low level) in response to the second input signal. The first holding part 350 may apply the second voltage to the first node Q in response to the voltage of a second node INV. The second holding part 360 may output the second voltage as the (k)th gate signal in response to the voltage of the second node INV.

The inverting part 370 may invert the voltage of the first node Q in response to the clock signal and the voltage of the first node Q. The inverting part 370 may apply the inverted voltage to the second node INV. The inverting part 370 may include a first inverting transistor T7 and a second inverting transistor T8. The first inverting transistor T7 may include a control electrode to which the clock signal is applied, an input electrode to which the clock signal is applied, and an output electrode connected to the second node INV. The second inverting transistor T8 may include a control electrode connected to the first node Q, an input electrode to which the second voltage is applied, and an output electrode connected to the second node INV.

The charging part 375 may include a first capacitor C1. The first capacitor C1 may include a first electrode connected to the second node INV and a second electrode connected to a second voltage terminal VSS providing the second voltage. The charging part 375 may stably maintain the voltage of the second node INV by reducing a leakage current of the inverting part 370. When the (k)th stage of the gate driving circuit does not include the charging part 375, the leakage current of the second node INV may occur in the second inverting transistor T8 of the inverting part 370, thereby causing the voltage of the second node INV to be dropped. In contrast, when the (k)th stage of the gate driving circuit includes the charging part 375, the charging part 375 having the first capacitor C1 between the second node INV and the second voltage terminal VSS may reduce the leakage current of the inverting part 370, and may maintain the voltage of the second node INV. A size of the first capacitor C1 may be determined so as to stably maintain the voltage of the second node INV. In one example embodiment, a capacitance of the first capacitor C1 may be proportional to the leakage current of the inverting part 370.

The first emission signal output part 380 may output the first voltage as the (k)th emission signal in response to the voltage of the second node INV. The second emission signal output part 390 may output the second voltage as the (k)th emission signal in response to the voltage of the first node Q.

Figure 6:
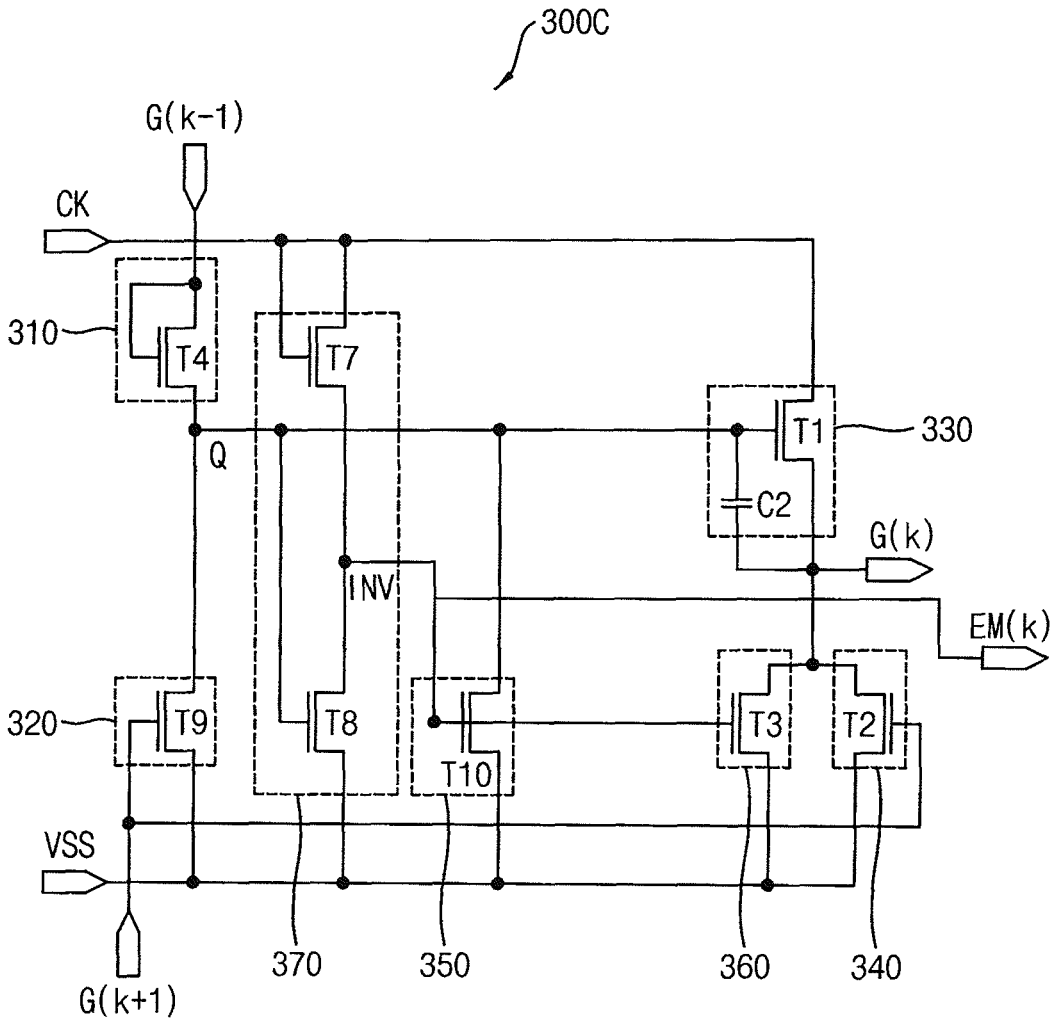
FIG. 6 is a circuit diagram illustrating still another example of an (k)th stage included in a gate driving circuit of FIG. 2.

FIG. 6 is a circuit diagram illustrating still another example of an (k)th stage included in a gate driving circuit (e.g., the gate driving circuit 300 of FIG. 2).

Referring to FIG. 6, a (k)th stage 300C of a gate driving circuit may include a first input part 310, a second input part 320, a first gate signal output part 330, a second gate signal output part 340, a first holding part 350, a second holding part 360, and an inverting part 370. The (k)th stage 300C according to the example embodiment illustrated in FIG. 5 is substantially the same as the (k)th stage of the example embodiment illustrated in FIG. 3, except that a first emission signal output part and a second emission signal output part are removed. Therefore, the same reference numerals will be used to refer to the same or like parts as those described with reference to the example embodiment illustrate in FIG. 3, and any repetitive explanation concerning the above elements will be omitted.

The first input part 310 may apply a first input signal to a first node Q in response to the first input signal. The second input part 320 may apply a second voltage to the first node Q in response to a second input signal. The first gate signal output part 330 may control the (k)th gate signal to a first logic level (e.g., high level) in response to the voltage of the first node Q. The second gate signal output part 340 may control the (k)th gate signal to a second logic level (e.g., low level) in response to the second input signal. The first holding part 350 may apply the second voltage to the first node Q in response to the voltage of a second node INV. The second holding part 360 may output the second voltage as the (k)th gate signal in response to the voltage of the second node INV.

The inverting part 370 may invert the voltage of the first node Q in response to the clock signal and the voltage of the first node Q. The inverting part 370 may apply the inverted voltage to the second node INV. The inverting part 370 may include a first inverting transistor T7 and a second inverting transistor T8. The first inverting transistor T7 may include a control electrode to which the clock signal is applied, an input electrode to which the clock signal is applied, and an output electrode connected to the second node INV. The second inverting transistor T8 may include a control electrode connected to the first node Q, an input electrode to which the second voltage is applied, and an output electrode connected to the second node INV.

The second node INV may be connected to the emission output terminal EM(k). Therefore, the voltage of the second node INV may be output as the (k)th emission signal. Thus, to reduce a size of the gate driving circuit, the stages of the gate driving circuit may output the voltage of the second node INV as the (k)th emission signal without the first emission signal output part and the second emission signal output part. Here, it may be desired to reduce the leakage current in the second inverting transistor T8 of the inverting part 370. For example, when the second inverting transistor T8 is a low temperature poly-silicon (LTPS) whose leakage current is relatively large, the voltage of the second node INV may be dropped by the leakage current occurring in the second inverting transistor T8 and the level of the (k)th emission signal may not be maintained. Therefore, the second inverting transistor T8 may be a transistor whose leakage current is relatively small. For example, the second inverting transistor T8 may be an n-type transistor through which a low current is flowed and the n-type transistor may be turned off in the positive voltage region to prevent the leakage current.

Figure 7:
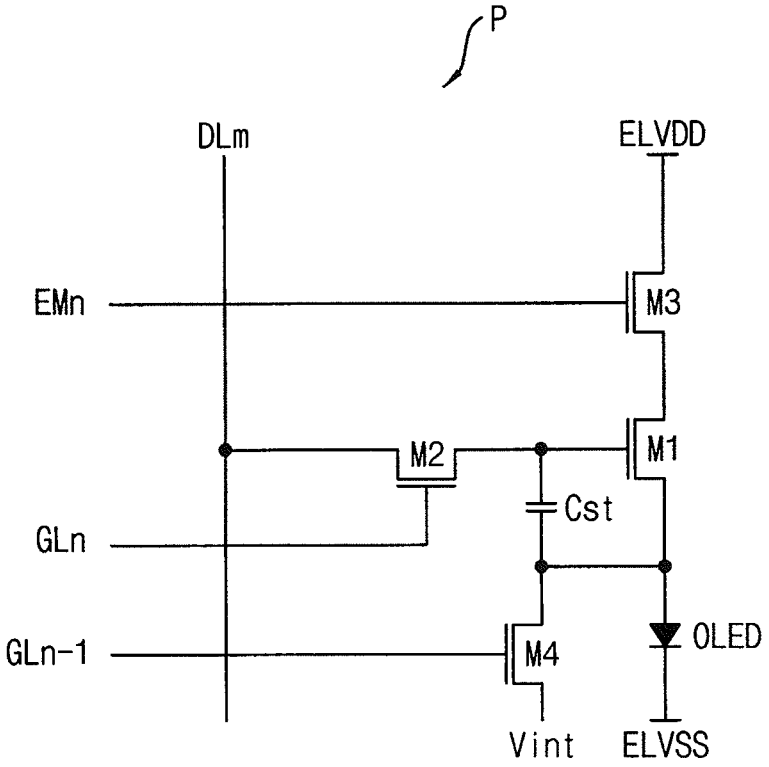
FIG. 7 is a circuit diagram illustrating an example of a pixel included in an organic light emitting display device of FIG. 1.

FIG. 7 is a circuit diagram illustrating an example of a pixel included in an organic light emitting display device (e.g., the organic light emitting display device 1000 of FIG. 1).

Referring to FIG. 7, a pixel circuit of pixel P may be connected to an (n)th gate line GLn, an (n)th emission line EMn, and a (m)th data line DLm. The pixel circuit may include a first transistor M1, a second transistor M2, a third transistor M3, a fourth transistor M4, and a storage capacitor Cst. The pixel circuit may charge the storage capacitor Cst to a voltage corresponding to a data signal and a threshold voltage of the first transistor M1 (e.g., driving transistor). An organic light emitting diode OLED may be provided a driving current corresponding to the charged voltage.

The second transistor M2 may include a control electrode connected to the gate line GLn, an input electrode connected to DLm, and an output electrode connected to a control electrode of the first transistor M1. The second transistor M2 may be turned on when a gate signal is provided from the gate line GLn and may transfer the data signal that is provided from the data line DLm to the control electrode of the first transistor M1.

The first transistor M1 may include the control electrode connected to the output electrode of the second transistor M2, an input electrode connected to an output electrode of the third transistor M3, and an output electrode connected to a first electrode (e.g., anode electrode) of the organic light emitting diode OLED. The first transistor M1 may control the amount of the driving current flowing from a high power voltage ELVDD to the organic light emitting diode OLED in response to the voltage of the control electrode of the first transistor M1.

The third transistor M3 may include a control electrode connected to the emission line EMn, an input electrode to which the high power voltage ELVDD is applied, and an output electrode connected to the input electrode of the first transistor ML. The third transistor M3 may be driven by the emission signal provided from the emission line EMn.

The storage capacitor Cst may include a first electrode connected to the control electrode of the first transistor M1, and a second electrode connected to the first electrode of the organic light emitting diode OLED. The storage capacitor Cst may be charged to a voltage corresponding to the data signal and the threshold voltage of the first transistor M1.

The fourth transistor M4 may include a control electrode connected to the previous gate line (e.g., the (n−1)th gate line) GLn−1, an input electrode to which an initial voltage Vint is applied, and an output electrode connected to the first electrode of the organic light emitting diode OLED. The fourth transistor M4 may be turned on when the previous gate signal is provided to the previous gate line GLn−1 and may initialize the first electrode of the organic light emitting diode OLED to the initial voltage Vint.

Therefore, the gate driving circuit according to example embodiments of the present disclosure may control the driving current flowing to the organic light emitting diode OLED by controlling the gate signals and the emission signals. Thus, the second transistor M2 may be turned on and the third transistor M3 may be turned off while the pixel circuit is charged by the data voltage. Also, the third transistor M3 may be turned on and the second transistor M2 may be turned off while the organic light emitting diode OLED emits light.

Although the example embodiments describe that the transistors are implemented as NMOS transistors, the transistors also can be implemented as PMOS transistors.

The techniques described herein may be applied to an electronic device having a display device. For example, the techniques described herein may be applied to a television, a computer monitor, a laptop, a cellular phone, a smart phone, a smart pad, a personal digital assistant (PDA), a portable multimedia player (PMP), a MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present disclosure. Accordingly, all such modifications are intended to be included within the scope of the present invention as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A gate driver comprising a plurality of stages, one of which comprising:

a first input circuit configured to apply a first input signal to a first node;

a first gate signal circuit configured to generate a first logic level in response to a voltage of the first node;

a second gate signal circuit configured to generate a second logic level in response to a second input signal;

an inverting circuit configured to invert the voltage of the first node in response to a clock signal and the voltage of the first node, the inverting circuit further configured to apply the inverted voltage to a second node;

a first emission signal circuit configured to generate a first voltage in response to a voltage of the second node;

a second emission signal circuit configured to generate a second voltage in response to the voltage of the first node; and a charging circuit including a first capacitor, the first capacitor having a first electrode connected to the second node and a second electrode connected to a second voltage terminal providing the second voltage.

2. The gate driver of claim 1, wherein the inverting circuit includes:

a first inverting transistor including a control electrode to which the clock signal is applied, an input electrode to which the clock signal is applied, and an output electrode connected to the second node; and a second inverting transistor including a control electrode connected to the first node, an input electrode to which the second voltage is applied, and an output electrode connected to the second node.

3. The gate driver of claim 1, wherein said one stage further comprises:

a second input circuit configured to apply the second voltage to the first node in response to the second input signal.

4. The gate driver of claim 3, wherein the second input circuit includes:

a second input transistor including a control electrode to which the second input signal is applied, an input electrode to which the second voltage is applied, and an output electrode connected to the first node.

5. The gate driver of claim 1, wherein said one stage further comprises:

a first holding circuit configured to apply the second voltage to the first node in response to the voltage of the second node.

6. The gate driver of claim 5, wherein the first holding circuit includes:

a first holding transistor including a control electrode connected to the second node, an input electrode to which the second voltage is applied, and an output electrode connected to the first node.

7. The gate driver of claim 1, wherein said one stage further comprises:

a second holding circuit configured to generate the second voltage in response to the voltage of the second node.

8. The gate driver of claim 7, wherein the second holding circuit includes:

a second holding transistor including a control electrode connected to the second node, an input electrode to which the second voltage is applied, and an output electrode connected to a gate output terminal outputting a gate signal of said one stage.

9. The gate driver of claim 1, wherein the first input circuit includes:

a first input transistor including a control electrode to which the first input signal is applied, an input electrode to which the first input signal is applied, and an output electrode connected to the first node.

10. The gate driver of claim 1, wherein the first gate signal circuit includes:

a first output transistor including a control electrode connected to the first node, an input electrode to which the clock signal is applied, and an output electrode connected to a gate output terminal outputting a gate signal of said one stage; and a second capacitor including a first electrode connected to the first node and a second electrode connected to the gate output terminal.

11. The gate driver of claim 1, wherein the second gate signal circuit includes:

a second output transistor including a control electrode to which the second input signal is applied, an input electrode to which the second voltage is applied, and an output electrode connected to a gate output terminal outputting a gate signal of said one stage.

12. The gate driver of claim 1, wherein the first emission signal circuit includes:

a third output transistor including a control electrode connected to the second node, an input electrode to which the first voltage is applied, and an output electrode connected to an emission output terminal outputting an emission signal of said one stage.

13. The gate driver of claim 1, wherein the second emission signal circuit includes:

a fourth output transistor including a control electrode connected to the first node, an input electrode to which the second voltage is applied, and an output electrode connected to an emission output terminal outputting an emission signal of said one stage.

14. A gate driver comprising a plurality of stages, one of which comprising:

a first input circuit configured to apply a first input signal to a first node;

a first gate signal circuit configured to generate a first logic level in response to a voltage of the first node and output a gate signal;

a second gate signal circuit configured to generate a second logic level in response to a second input signal; and an inverting circuit configured to invert the voltage of the first node in response to a clock signal and the voltage of the first node, the inverting circuit further configured to apply the inverted voltage to a second node and cause a voltage of the second node to be output as an emission signal.

15. The gate driver of claim 14, wherein the inverting circuit includes:

a first inverting transistor including a control electrode to which the clock signal is applied, an input electrode to which the clock signal is applied, and an output electrode connected to the second node; and a second inverting transistor including a control electrode connected to the first node, an input electrode to which a second voltage is applied, and an output electrode connected to the second node.

16. The gate driver of claim 14, wherein said one stage further comprises:

a second input circuit configured to apply a second voltage to the first node in response to the second input signal.

17. The gate driver of claim 14, wherein said one stage further comprises:

a first holding circuit configured to apply a second voltage to the first node in response to the voltage of the second node.

18. The gate driver of claim 14, wherein said one stage further comprises:

a second holding circuit configured to generate a second voltage in response to the voltage of the second node.

19. A display device comprising:

a display panel including a plurality of gate lines, a plurality of emission lines, a plurality of data lines crossing the gate lines and the emission lines, and a plurality of pixels;

a data driver configured to output a plurality of data signals to the data lines, respectively; and a gate driver including a plurality of stages, one of which comprising:

a first input circuit configured to apply a first input signal to a first node;

a second input circuit configured to apply a second voltage to the first node in response to a second input signal;

a first gate signal circuit configured to generate a first logic level in response to a voltage of the first node;

a second gate signal circuit configured to generate a second logic level in response to the second input signal;

an inverting circuit configured to invert the voltage of the first node in response to a clock signal and the voltage of the first node, the inverting circuit further configured to apply the inverted voltage to a second node;

a first holding circuit configured to apply the second voltage to the first node in response to a voltage of the second node;

a second holding circuit configured to generate the second voltage in response to the voltage of the second node;

a first emission signal circuit configured to generate a first voltage in response to the voltage of the second node; and a second emission signal circuit configured to generate the second voltage in response to the voltage of the first node, wherein the gate driver outputs both gate signals and emission signals.

20. The display device of claim 19, wherein the emission signals are output without an emission driving circuit.

* * * * *